United States Patent [19]

Agar

[11] 4,149,663

[45] Apr. 17, 1979

[54] BASKET WITH REMOVABLE HANDLE

[76] Inventor: Richard L. Agar, R.R. 1, Sibley, Iowa 51249

[21] Appl. No.: 844,073

[22] Filed: Oct. 20, 1977

[51] Int. Cl.[2] ..... B65D 7/20; B65D 25/32

[52] U.S. Cl. ..... 224/45 W; 16/114 R; 206/805; 220/19; 220/95; 224/48 W

[58] Field of Search ..... 220/95, 96, 19, 94 R; 206/805; 229/52 AW; 16/114 R, 110.5; 403/346, 400; 24/129 D, 81 CR; 217/12 S; 224/45 T, 48 E, 45 W, 48 W

[56] References Cited

U.S. PATENT DOCUMENTS

| | | | |
|---|---|---|---|
| 254,942 | 3/1882 | Emery | 220/95 |
| 470,947 | 3/1892 | McLauchlan | 220/95 |
| 1,950,376 | 3/1934 | Alexander | 224/48 W |
| 2,180,787 | 11/1939 | Aukland | 220/326 |
| 2,998,155 | 8/1961 | Elskamp | 217/125 |
| 3,128,905 | 4/1964 | Hesslein | 220/95 |

FOREIGN PATENT DOCUMENTS

| | | | |
|---|---|---|---|
| 455622 | 4/1949 | Canada | 220/19 |
| 411317 | 6/1934 | United Kingdom | 220/91 |

*Primary Examiner*—William Price
*Assistant Examiner*—Allen N. Shoap

[57] ABSTRACT

A wire basket with a bail type handle or dual bail handles which are removable and may be flexibly attached to the basket.

2 Claims, 4 Drawing Figures

BASKET WITH REMOVABLE HANDLE

BACKGROUND AND SUMMARY OF THE INVENTION

This invention pertains to wire baskets and more particularly to a wire basket or carrier with a bail type handle which is easily removable.

The use of wire carriers for the handling of packages is well known. Such baskets mounted on wheels form the familiar grocery cart. Prior to that, wire baskets having divisions to set out specific areas of the basket were used for home delivery of milk in returnable bottles. Somewhat similar carriers—although usually round or oval in plan form—are used by home canners to hold canning jars in the heated container, whether a pressure canner or hot water bath.

In nearly all of the above cited uses of baskets or carriers, the handles are fixed or at least permanently attached. The result is that, especially with fixed handles, the carrier is clumsy for the manufacturer and seller to store or to ship. The removable handle of my invention is also very easy to assemble so that the cost of manufacture may be reduced to a minimum.

FIGURES

DESCRIPTION

Figure 1:
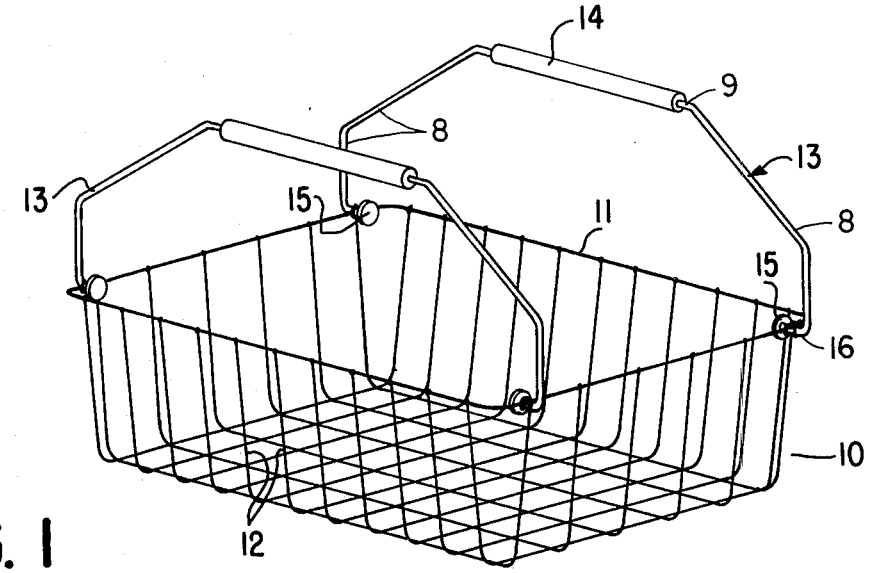
FIG. 1 is a pictorial view of the basket of my invention.

Briefly my invention comprises a wire basket with a bail type handle, or preferably with a pair of handles which are attached to the basket by a flexible O-ring so that they may be easily removed and reattached.

More specifically and referring to the drawings, I provide a carrier comprising a wire basket 10 having an upper rim 11 formed of heavier wire than the rest of the basket. Vertical members 12 extend from the rim to form the sides of the basket and then are bent to form the bottom.

The handles 13 for the carrier are of the bail type and include a grip member 14 on each handle. The handle 13 is formed with a transverse first section 9 from which extends at both ends a downwardly extending second section 8. A third section 16 forms the end of the handle and is substantially parallel to the first section 9. At the ends of the handle I provide a disk 15 attached so as to provide an enlarged end or collar which will hold the handle from movement out of an opening beneath the rim and into which the end 16 of the handle might be inserted.

The end 16 is bent so as to be approximately parallel to the grip and is then in position to be inserted under the rim 11 near the corners of the basket. Because of the collar, it is unlikely to slip off of the rim while there is pressure between the handle end 15 and the rim as there is while the basket is being carried. However, when the basket is set down, the pressure is relaxed and the handle can fall down. Therefore it is necessary that means be provided to hold the handles to the rim.

Figure 2:
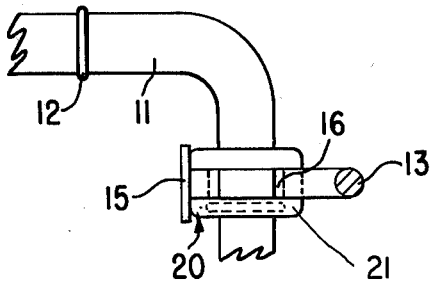
FIG. 2 is a detailed top plan view to an enlarged scale of the attachment between the handle and the carrier.
Figure 4:
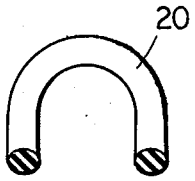
FIG. 4 is a pictorial view of a section of the O-ring showing its toroidal shape.
Figure 3:
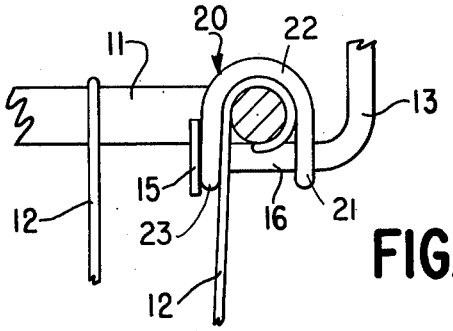
FIG. 3 is an elevational view of the attachment as shown in FIG. 2.

For that purpose, I use an O-ring 20 formed of rubber or similar material. The ring, as is clearly shown in FIGS. 2 and 3, is looped as at 21 around the bent end 16 of the handle, is then pulled over the rim 11 as at 22 adjacent the end 16 and then is hooked over the disk 15 and therefore back around the end 16 as at 23 so that the ring 20 holds the handle in contact with the rim. However, it is obvious that the handle is now easily removable simply by unhooking the O-ring from the disk.

Thus, I achieve an easily removable handle and one in which the attachment is somewhat flexible so that a vertical upward shock on the basket is not transmitted to the handle.

I claim:

1. A carrier including a wire basket having an upper rim, said rim having four sides and being substantially of rectangular form and having two pairs of opposing side walls extending downwardly thereform a given distance to a bottom wall interconnecting said side walls, detachable handle means for said basket, said handle means comprising a first section extending transversely of one pair of opposing side walls above said rim, a second section extending downwardly from each end of each first section, a third section extending from each second section towards said portion of rim attached to said one pair of side walls, a flat disc attached to each third section, each third section attached to substantially the center of said disc, each disc having a greater area than the cross section of said handle means at said third section, each third section being placed to contact the underside of each side of said rim of said one pair, said disc and a portion of each third section extending adjacent to said rim, flexible O-ring attachment means removably securing each third section to the rim, each O-ring means extending from and contacting the underside of said portion of each said third section located between said disc and said rim, thence across the top of said rim, thence around the third section between said rim and said second section and contacting the underside of said third section.

2. The device of claim 1 in which there are at least a pair of handles on said basket.

* * * * *